US006579996B2

(12) United States Patent
Peter et al.

(10) Patent No.: US 6,579,996 B2
(45) Date of Patent: Jun. 17, 2003

(54) PROCESS FOR REMOVING FREE FATTY ACIDS FROM FATS AND OILS OF BIOLOGICAL ORIGIN OR THEIR STEAM DISTILLATES

(76) Inventors: Siegfried Peter, Lindenweg 3, 91080 Uttenreuth (DE); Eckhard Weidner, Am Dorfweiher 9, 91056 Erlangen (DE); Martin Drescher, Johannisstrasse 160, 90419 Nürnberg (DE); Wolfgang König, Barbarastrasse 15, 92245 Lengenfeld (DE)

( * ) Notice: Subject to any disclaimer, the term of this patent is extended or adjusted under 35 U.S.C. 154(b) by 40 days.

(21) Appl. No.: 10/046,063

(22) Filed: Oct. 20, 2001

(65) Prior Publication Data

US 2002/0111504 A1 Aug. 15, 2002

Related U.S. Application Data

(63) Continuation of application No. PCT/EP00/03498, filed on Apr. 18, 2000.

(30) Foreign Application Priority Data

Apr. 21, 1999 (DE) ..... 199 18 097

(51) Int. Cl.[7] ..... C11B 3/00
(52) U.S. Cl. ..... 554/15; 554/184; 554/175
(58) Field of Search ..... 554/184, 185

(56) References Cited

U.S. PATENT DOCUMENTS

| | | | | |
|---|---|---|---|---|
| 1,885,859 A | 11/1932 | Rosenstein et al. | | |
| 2,157,882 A | 5/1939 | Ashworth | ..... | 260/425 |
| 2,164,012 A | 6/1939 | Hund et al. | ..... | 260/425 |
| 2,200,391 A | 5/1940 | Freeman | ..... | 87/6 |

FOREIGN PATENT DOCUMENTS

| | | | |
|---|---|---|---|
| EP | 478930 | * | 1/1938 |
| GB | 478930 | | 1/1938 |
| GB | 764833 | | 1/1957 |

OTHER PUBLICATIONS

E.R. Cousins et al., "Ethanolamines and Other Amino–and Hydroxyl–Containing Compounds in the Refining of Rice Oil," vol. 3, Nov. 1955, pp. 561–564.

E. Bernadini, "Neutralisation," Chapter IV, pp 165–167, 1955.

* cited by examiner

*Primary Examiner*—Deborah D. Carr
(74) *Attorney, Agent, or Firm*—Webb Ziesenheim Logsdon Orkin & Hanson, P.C.

(57) ABSTRACT

A method for removing free fatty acids from fats or oils of biological origin or their steam distillates by extracting the free fatty acids with a mixture of basic organic nitrogen compounds and water as an extraction medium at a temperature below the boiling point of the organic nitrogen compounds. The content of the basic organic nitrogen compounds in the extraction medium is 20–30% by weight. In this manner, the formation of a viscous soapstock which is difficult to remove is prevented. The boiling point of the basic organic nitrogen compounds used is the same as or above boiling point of water and below the boiling point of the fatty acids to be extracted in order to enable simple recovery of the extraction medium.

22 Claims, 1 Drawing Sheet

PROCESS FOR REMOVING FREE FATTY ACIDS FROM FATS AND OILS OF BIOLOGICAL ORIGIN OR THEIR STEAM DISTILLATES

CROSS-REFERENCE TO RELATED APPLICATIONS

This application is a continuation of International Patent Application Number PCT/EP00/03498 filed on Apr. 18, 2000, entitled "Method For Eliminating Free Fatty Acids From Fats And Oils Of Biological Origin Or Their Vapor Condensates" and designating, inter alia, the United States, which claims priority to German Patent Application Serial No. 199 18 097.0, filed Apr. 21, 1999.

BACKGROUND OF THE INVENTION

1. Field of the Invention

The present invention relates to a process for removing free fatty acids from fats and oils of biological origin or their steam distillates by extraction.

2. Description of the Related Art

In human nutrition, and as raw materials for the chemical industry, oils and fats of biological origin play an important role. For example, they serve as raw materials for production of surfactants, plasticizers, waxes, lubricants, fatty alcohols etc. Essential components of fats and oils are the triesters of glycerides and fatty acids, the so-called triglycerides. The physical properties of fats and oils are determined a) by the chain length of the fatty acids, b) by the degree of saturation of the fatty acids and c) by the distribution of the various fatty acids on the three hydroxyl groups of the glycerol. Fats having a high saturated fatty acid content are generally solid at ambient temperature. Fats or oils, respectively, from predominantly unsaturated fatty acids are liquid at ambient temperature.

The fats and oils of biological origin comprise a number of secondary products which adversely affect the keeping quality, odour, flavour and appearance. The most important secondary products are: suspended matter, organic phosphorus compounds, free fatty acids, pigments and odour compounds. Mucilaginous material (gums) and other complex colloidal compounds can promote hydrolytic degradation of fats and oils during their storage and interfere during further refining. Therefore, they are removed by the process of what is termed degumming. Degumming is based on hydration with water or direct steam. The organic phosphorus compounds (phosphatides) take up water in the course of this, swell and become insoluble.

After phosphorus compounds and suspended matter have been removed by degumming and, if appropriate filtration, the further object is to separate off free fatty acids and pigments and odour compounds. Commercial crude fats and crude oils comprise on average from 1 to 3% by weight of free fatty acids, high-grade types 0.5% by weight or less, some palm, olive and fish oils 20% by weight or more. The fatty acid content of the refined fats and oils is, by comparison, generally to be below 0.1% by weight. Whereas relatively long-chain free fatty acids do not usually cause flavour impairment, the short-chain fatty acids have a soapy, rancid flavour. In practice, the deacidification performed for removing the free fatty acids is predominantly carried out by treatment with aqueous alkali solutions or by steaming at temperatures of approximately 220° C. Removing the free fatty acids by esterification with glycerol or a monohydric alcohol, by selective solvent extraction or by adsorbents, is of lower importance, by comparison. Below, the deacidification processes known hitherto are described in more detail.

The treatment with alkaline solutions, as the method most employed, can be carried out batchwise or continuously. The higher the lye concentration, the more readily are unwanted accompanying substances taken up into the resulting soap, termed the soapstock. Weakly alkaline solutions are generally sprayed onto the oil at 90° C. and percolate downwards through the heated oil. In contrast, stronger lyes (4n to 7n) are usually stirred into the oil at from 40 to 80° C. After the deacidification and removal of the soapstock, the oil or fat is washed with highly dilute lye (approximately 0.5n) and thereafter with water, in order to remove soap residues down to at least 0.05% by weight. With the use of centrifuges, a completely continuous plant for neutralizing fats and oils can be constructed according to this method. If the fats and oils to be deacidified have a high content of free fatty acids, the deacidification using alkaline solutions leads to a relatively hard soapstock which can only be removed from the plant with difficulty.

Therefore, what is termed steam deacidification has been developed as an alternative In this process, which is also termed physical refining or deacidification by distillation, the free fatty acids are likewise continuously removed from the crude oils by hot steam under vacuum. This process does not depend on the free fatty acids being distilled off completely, since fatty acids remaining in a small amount can expediently be removed by a secondary lye refining. Before the deacidification by distillation, the crude fat must, however, be freed as completely as possible from gums, phosphatides and metal traces—usually by treatment with phosphoric acid—since the accompanying substances can lead, during the distillation, to dark, unpleasant-tasting substances, which can then virtually no longer be removed. The steam deacidification takes place at relatively high temperatures; for example palm oil is deacidified by superheated direct steam at 220° C. The high temperature destroys a great number of substances which are present in the oil (or fat) and are desirable per se, for example the antioxidants which improve the keeping quality of the oil, or forces these substances into what is termed the steam distillate which is produced after condensation of the superheated steam used for the deacidification.

The neutralization of oils and fats by separating off the free fatty acids from the crude fat by means of selective solvents is another method which is suitable, especially, for high-acidity oils and fats. For example, liquid extraction using ethanol makes possible the deacidification of olive oil having 22% by weight of free fatty acids down to approximately 3% by weight of free fatty acids. Another extraction medium which dissolves, at suitable temperatures, only free fatty acids and very highly unsaturated triglycerides, is furfural. In yet another process, the Selexol process, liquid propane is used as extraction medium in countercurrent. Liquid propane selectively dissolves saturated neutral oil, while fatty acids, oxidation products, unsaponifiables and highly unsaturated glycerides are hardly dissolved at all and remain behind. This process is chiefly used for fractionating fish oils and fish liver oils.

The selective extraction process is used industrially virtually exclusively for fats having a very high free fatty acid content. Examples of these are: cocoa butter from shells, olive oil from the press cake, low quality grades of rice oil and cottonseed oil. The alcohol used in this process is isopropyl alcohol. To deacidify one ton of oil, Bernardini (E. Bernardini, Oilseeds, Oils and fats, Publishing House Rome, 1985) quotes the following levels of consumption: energy and auxiliaries, steam 800 kg, electrical energy 14 kWh, hexane 15 kg, isopropanol 18 kg. Oil produced in this manner is not used as edible oil.

Although the degumming and alkali refining already lead to a certain clearing, generally, a decolourizing stage is further provided. Decolourizing is customarily performed using solid adsorbents, such as bleaching earth and activated carbon. Bleaching with air or chemicals plays a minor role in edible fats.

In the last phase of the refining process, odour and flavour substances are removed from the deacidified and bleached oils and fats. Deodorization is essentially a steam distillation in which the volatile compounds are separated off from the non-volatile glycerides. The odour and flavour substances are predominantly aldehydes and ketones which are formed by autoxidative or hydrolytic reactions during the processing and storage of the fats and oils. The low partial pressure of the compounds to be removed requires that the steaming is carried out under reduced pressure. Steaming is usually carried out from 180 to 220° C. and a pressure of from 6 to 22 mbar.

For environmental protection reasons, wastewaters from the alkaline deacidification must be carefully treated, which is associated with costs. Therefore, most recently, the interest in physical processes for refining oils and fats has been revived. As early as in the 1920s, the possibilities of deacidification using liquid-liquid extraction with aqueous lower alcohols were studied (Baley, 5th edition 1996, volume 5). The best extraction medium was found to be aqueous ethyl alcohol. Although in its selectivity with respect to free fatty acids and triglycerides, pure methanol is more expedient, it has not been studied in more detail for its suitability as an extraction medium for deacidifying fats and oils—presumably because of its toxicity.

Deacidifying oils and fats using amines was proposed as early as 1937 in U.S. Pat. No. 2,164,012. An alkanolamine, preferably ethanolamine, is proposed as alkaline extraction medium which dissolves the free fatty acids as soaps in the aqueous phase. Alkanolamine residues dissolved in the raffinate are extracted by washing with dilute sulphuric acid, acetic acid, lactic acid, citric acid or hydrochloric acid solutions.

U.S. Pat. No. 2,157,882 likewise proposes, instead of extracting the free fatty acids with sodium hydroxide solution, extracting with an alkanolamine to remove the majority of the free fatty acids and some of the pigments. However, the oil thus treated is cloudy and has a tendency to decompose during storage. Therefore, it is proposed to follow the wash with ethanolamine by a wash with a dilute sodium hydroxide solution. The deacidified oil is thereafter washed with water, in order to remove the last traces of alkali.

In an article which appeared in 1955 in Journal of the American Oil Chemist's Society (JAOCS, vol. 32, 1955 pp. 561–564), experiments on refining rice oil with monoethanolamine, triethanolamine, tetraethanolammonium hydride, ethylenediamine, ethylamine and triethylamine are reported. Rice oils comprise approximately from 5 to 7% by weight of free fatty acids. The high fatty acid content usually leads, in alkaline refining, to high fat losses. These losses can be decreased to values of from 3 to 5% by weight by adding the said amines prior to the customary refining.

As can be seen by the above description of the various deacidification processes, these processes are either burdened with plant-engineering problems and/or are relatively cost-intensive, due to their consumption of auxiliaries and energy and a downstream work-up which may be required. In addition, in some processes, fat and oil constituents which are wanted per se are destroyed.

SUMMARY OF THE INVENTION

The object therefore underlying the invention is to specify an improved process for deacidifying oils and fats of biological origin which, firstly, can overcome even high contents of free fatty acids without plant-engineering problems and, secondly, enables the production of very high-quality grade fats and oils, as are wanted, for example, by the food industry.

This object is achieved according to the invention by the process described herein. The process of the invention is based on the fact that, surprisingly, when oils (or fats) having a high free fatty acid content are deacidified by aqueous solutions or organic bases, for example 2-dimethylaminoethanol, no viscous soapstock forms if the amine content in the aqueous solution is high. Instead, under such conditions, both the oil phase and the extract phase are low-viscosity liquids. The phase separation proceeds in this case rapidly within a few minutes; the resulting phases are clear.

In contrast, at aqueous solution amine contents which correspond to the concentrations of the sodium hydroxide solutions in the chemical deacidification, a high-viscosity soapstock formed. More detailed study found that the basic nitrogen compound must contain at least approximately 40% by weight of water so that two phases are formed in equilibrium with the oil to be deacidified. Conversely, the concentration of the organic base, for example 2-dimethylaminoethanol, in the aqueous solution must be at least approximately 20% by weight, even better 30 to 40% by weight so that no viscous soapstock or cloudy phases are formed. This means that the aqueous solution used for the deacidification must have according to the invention a content of approximately from 20% by weight to about 60% by weight of organic nitrogen compound.

If, for example, palm oil having a free fatty acid content of 4.5% by weight is mixed at 50° C. with a solution of 55% by weight of 2-dimethylaminoethanol in water in a ratio of 1:1, after separating the phases an oil is obtained which, minus the extraction medium, comprises only 0.03% by weight of free fatty acids at an oil loss of merely 0.8% by weight. By means of the extraction process of the invention, a mild-temperature and efficient deacidification is thus possible at low oil losses in a few stages in countercurrent.

Residues of the basic nitrogen compounds dissolved in the raffinate are preferably extracted with water or with dilute acetic acid, lactic acid, citric acid, sulphuric acid or hydrochloric acid solutions. Alternatively, traces of the basic extraction medium in the raffinate are removed by stripping with carbon dioxide. During the stripping with carbon dioxide, at the same time, the oil is dried. The carbon dioxide can be used as dilute gas or as dense, supercritical gas for removing traces of the basic nitrogen compounds used from the raffinate.

Extraction of the extraction medium used according to the invention (for example an aqueous solution of 2-dimethylaminoethanol) from the extract may be performed in a simple manner by distillation. It is a precondition here that the vapour pressure of the water is approximately equal to or above the vapour pressure of the basic nitrogen compound(s) used. The water and the basic organic compound are distilled off together or the water is preferably distilled off first, the ratio of basic compounds to water being constant or increasing and the formation of a viscous soapstock being avoided. If the vapour pressure of the basic compound were to be higher than the water vapour pressure, the ratio of basic compound to water would decrease and finally a viscous soapstock would begin to form. In other words, the boiling point of the basic nitrogen compound(s) has to firstly be equal to or above the boiling point of water and secondly must be below the boiling point of the fatty acids to be extracted.

Suitable basic organic compounds for the process of this invention should have the following properties: a) the compound shall, if possible, not form amides with the free fatty acids; b) the compound shall be miscible with water in any ratio; c) the boiling point of the compound shall be equal to or above that of water, d) the odour nuisance due to the aqueous solutions shall be as small as possible. Examples of suitable organic nitrogen compounds are: N-methylmorpholine, 2-dimethylaminoethanol, 3-(diethylamino)-1-propanol, 2-diethylaminoethanol, 1-(dimethylamino)-2-propanol, dimethylformamide, N-methylmorpholine, 2-methylethylaminoethanol, 2-dibutylaminoethanol, dimethylformamide, morpholine, 2-diisopropylaminoethanol, etc. In general, tertiary amines, because of their higher basicity, are preferred to binary and monosubstituted amines.

Examples of starting materials which can readily be deacidified by the process of the invention are beef tallow, lard, fish oil, corn oil, rendered fats, palm oil, soy oil, rapeseed oil, sunflower seed oil, rice germ oil, cotton seed oil, olive oil, groundnut oil, safflower oil, coconut oil, palm kernel oil, grape-seed oil, wheat germ oil etc. Before the process of the invention is used, the oils and fats to be deacidified should be degummed and filtered, in particular if more than 100 ppm of phosphatides are present. The fat or oil thus prepared still contains dissolved oxygen which should likewise be removed before further processing. By means of the process according to the invention, the starting material is then deacidified with preservation of temperature-sensitive compounds, such as carotenes, tocotrienols, tocopherols etc. These compounds, which are, inter alia, also of nutritional importance, are largely destroyed or expelled during conventional physical refining which is carried out by means of direct steam, owing to the high temperatures.

In a somewhat modified form, the process according to the invention is also outstandingly suitable for removing the free fatty acids from the steam distillates of the fats and oils which have been deacidified using the abovementioned conventional physical refining, i.e. by steam deacidification.

These steam distillates generally comprise free fatty acids at very high concentrations, generally in the range from about 80 to 94% by weight. Because of the high free fatty acid content, the extraction medium used according to the invention, i.e. the mixture of organic base and water, must however be richer in the basic nitrogen compound than described above in connection with the deacidification of fats and oils. The content of organic nitrogen compound in the extraction medium should be at least approximately 40% by weight. If such a basic-nitrogen-compound-rich aqueous solution, for example 60% by weight of 2-dimethylaminoethanol and 40% by weight of water, is added to the liquid steam distillate as extraction medium, a liquid homogeneous mixture is obtained. To this liquid mixture are then added from one to four parts, preferably from two to four parts, of an alkane and/or an ester, in particular an acetate, to one part of liquid mixture. From the previously homogeneous mixture, as a result, two coexisting liquid phases are formed of which the aqueous phase highly selectively contains the free fatty acids.

In the alkane and/or ester phase are dissolved essentially the fats and oils present in the steam distillate. The secondary products also dissolved in the steam distillate, such as tocopherols, tocotrienols and phytosterols, likewise pass highly selectively over into the alkane phase. The aqueous phase having the free fatty acids present therein is of low viscosity, so that phase separation is performed approximately within 20 minutes after interrupting the mixing.

The raffinate (alkane phase or ester phase) resulting after separating off the aqueous phase is, depending on the starting product, highly enriched in secondary products such as tocopherols, phytosterols, tocotrienols. Producing these valuable secondary products from such concentrates is possible under economically attractive conditions.

Suitable alkanes are, for example, propane, butane, hexane, petroleum ether, heptane, heptane fractions, octane etc. When butane or propane is used as solvent for the formation of two phases, the pressure in the mixing vessel must at least correspond to the respective vapour pressure, so that the butane or propane is present in liquid form. Suitable esters are, in particular, the acetates, for example ethyl acetate, propyl acetate, butyl acetate or a mixture thereof.

In the process according to the invention, if the free fatty acid concentration in the starting material to be treated (oil, fat or steam condensate) is more than approximately 50% by weight, the addition of alkanes is generally required for the overall system (starting material and extraction medium) to remain in two phases. The addition of alkane or ester therefore, even at high free fatty acid concentrations in the starting mixture, ensures the formation of two easil handled liquid phases, and by means of the extraction medium used according to the invention, by an extraction in countercurrent, extracts having high free fatty acid concentrations can be obtained. The solvent ratio can therefore be low, which has an advantageous effect on the economic efficiency of the process according to the invention.

BRIEF DESCRIPTION OF THE DRAWING

An embodiment of the process according to the invention is described in more detail with reference to FIG. 1 showing a process flow chart.

DESCRIPTION OF THE PREFERRED EMBODIMENT

Figure 1:
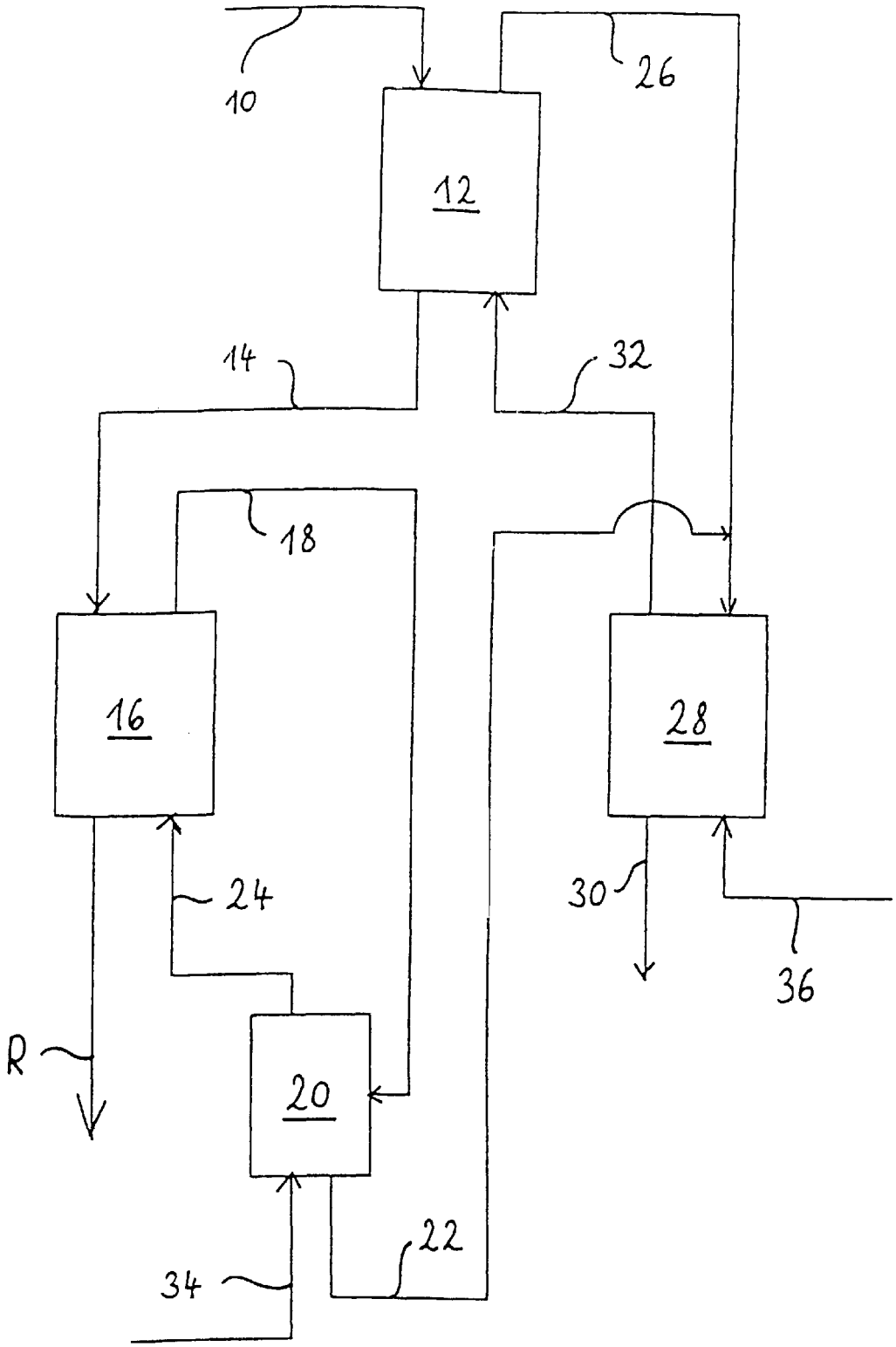

Via a line 10, a starting product (oil, fat or steam distillate) is fed to a first extraction tower 12. In the extraction tower 12, the free fatty acids are highly selectively extracted from the starting product with an extraction medium which consists of a mixture of a basic nitrogen compound and water. The extraction medium used comprises at least approximately 20% by weight and at most 80% by weight of the organic nitrogen compound (organic base). Particularly favourable proved concentrations of the basic nitrogen compound of approximately 30 to 40% by weight. But the basic nitrogen compound concentration may as well be chosen to be even higher.

The oil or fat freed from the free fatty acids is fed via a line 14 to a wash tower 16 (extraction tower), in which residues of the basic nitrogen compound are washed out with water or an aqueous solution which comprises an acid, and leaves the wash tower 16 as raffinate R. The wash solution exiting at the top of the wash tower 16 via a line 18 is then worked up by distillation in a distillation tower 20. During this, water and, if appropriate, the volatile acid (for example acetic acid) dissolved in the water is distilled off until the bottom product of the distillation tower 20 has reached the composition of the extraction medium. This bottom product is then passed via a line 22 to the extraction medium cycle described below, while the distillate of the distillation tower 20 is fed as wash liquid via a line 24 to the abovementioned wash tower 16.

The extraction medium which comprises the free fatty acids and is taken off at the top of the extraction tower 12 is fed via a line 26 to a second distillation tower 28. Water and the basic nitrogen compound are produced as overhead product during the distillation in the distillation tower 28, while the extract comprising the extracted free fatty acids and some neutral oil is taken off as bottom product from the distillation tower 28 via a line 30. The overhead product of the distillation tower 28 is fed as extraction medium via a line 32 to the extraction tower 12 in which the extraction of the free fatty acids takes place, which completes the extraction medium cycle. The energy required for the distillation is fed in the form of heating steam via lines 34 and 36 to the distillation towers 20 and 28.

In this manner, by extraction, an acid-free oil or fat is produced as raffinate and the extracted free fatty acids, which still comprise small amounts of neutral oil, are produced, in a closed circuit of all auxiliaries. No waste streams are formed. Secondary products, for example tocopherols, tocotrienols, carotenes, phytosterols, cholesterols, etc., which are present in the starting product remain in the raffinate R.

A number of experiments, which are described below, were carried out using the process according to the invention.

EXAMPLE 1

250 g of an oil comprising 95.5% by weight of neutral oil, 4.2% by weight of free fatty acids and 1.7% by weight of tocopherol were mixed with 100 g of 2-dimethylaminoethanol and 70 g of water at 50° C. by stirring. After interrupting the mixing operation and separating the two liquid phases, samples were taken from both phases and analysed. The extraction-medium-rich phase comprised, minus extraction medium, 53.7% by weight of neutral oil, 45.0% by weight of free fatty acids and 0.3% by weight of tocopherol. The oil-rich raffinate phase comprised, minus extraction medium, 98.2% by weight of neutral oil, 0.05% by weight of free fatty acids and 1.8% by weight of tocopherol.

EXAMPLE 2

200 g of an oil comprising 5.5% by weight of free fatty acids and 1.8% by weight of tocopherols were mixed at 50° C. with 150 g of an extraction medium which comprised 40% by weight of water and 60% by weight of 2-dimethylaminoethanol. After interrupting the mixing operation and phase separation, one sample was taken from each of the two coexisting liquid phases and analysed. The extract phase had a loading of 8.9% by weight. Minus the extraction medium, the extract consisted of 92% by weight of free fatty acids, 0.3% by weight of tocopherols and 7.7% by weight of glycerides. The raffinate phase comprised, minus the extraction medium, 0.05% by weight of free fatty acids, 1.8% by weight of tocopherol and 98.2% by weight of glycerides.

EXAMPLE 3

200 g of an oil having 5.1% by weight of free fatty acids and 0.3% by weight of tocopherols was mixed with an extraction medium consisting of 100 g water and 100 g pyridin at 60° C. After interrupting the mixing operation and phase separation, one sample was taken from each of the two coexisting liquid phases and analysed. The extract phase had a loading of 2.1% by weight. Minus the extraction medium, the extract comprised 20.8% by weight of free fatty acids, 0.3% by weight of tocopherol and 95.8% by weight of glycerides. The raffinate comprised, minus the extraction medium, 4.2% by weight of free fatty acids, 0.3% by weight of tocopherols and 95.1% by weight of glycerides.

EXAMPLE 4

151 g of an oil having a composition of 4.3% by weight of free fatty acids, 1.4% by weight of tocopherol, 0.6% by weight of stigmasterol and 93.7% by weight of neutral oil were mixed at 50° C. with 150 g of an extraction medium comprising 60% by weight of 2-(dimethylamino)ethanol and 40% by weight of water. After terminating the mixing operation, two phases were produced in the course of about 10 minutes. After removing a slight turbidity by centrifugation, samples were taken from both phases and analysed. The extract phase, minus the extraction medium, had the following composition: 84% by weight of free fatty acids, 0.5% by weight of tocopherol, 0.5% by weight of stigmasterol and 15% by weight of neutral oil. The raffinate comprised 0.05% by weight of free fatty acids, 1.4% by weight of tocopherol, 0.6% by weight of stigmasterol and 97.95% by weight of neutral oil. In the extract there remained 0.46% by weight of the initial amount of neutral oil.

EXAMPLE 5

300 g of palm oil having a content of 4.5% by weight of free fatty acids, 0.4% by weight of tocols, 0.15% by weight of stigmasterol, 94.95% by weight of neutral oil were mixed at 50° C. with 42 g of an extraction medium which comprised 60% by weight of 2-(dimethylamino)ethanol and 40% by weight of water. After terminating the mixing operation and phase separation, which lasted for about 35 minutes, samples were taken from both phases and analysed. The extract comprised, minus the extraction medium, 40.0% by weight of free fatty acids, 0.4% by weight of tocopherols, 0.25% by weight of stigmasterol and 59.35% by weight of neutral oil. The raffinate consisted, minus extraction medium, of 0.3% by weight of free fatty acids, 0.4% by weight of tocopherols, 0.1% by weight of stigmasterol and 99.4% by weight of neutral oil. 6% by weight of the initial amount of neutral oil were present in the extract. The solvent ratio had the low value of 0.14.

EXAMPLE 6

100 g of palm oil having a free fatty acid content of 5.5% by weight were mixed with 100 g of a mixture of 30 g N,N-dimethylamino-ethanol and 70 g water by stirring at 60° C. After interrupting the mixing operation, the phase separation which had taken place after approximately 3 minutes was waited for and samples were taken from both coexisting liquid phases and analysed. The palm oil (raffinate) contained, minus extraction medium, less than 0.1% by weight of free fatty acids. The extract comprised, minus extraction medium, 77% by weight of free fatty acids and 23% by weight of glycerides (mono-, di- and triglycerides; the latter the main component). Approximately 1.2 g glycerides (about 1.2% of the weighed sample) were extracted together with the free fatty acids.

EXAMPLE 7

100 g of palm oil with 4.3% by weight of free fatty acids were mixed at 80° C. with a solution consisting of 40% by weight of N,N-dimethylamino-ethanol in water by stirring. After separating the coexisting phases, samples were taken from each one of the phases and analysed. The extract comprised, minus extraction medium, of 67% by weight of free fatty acids and 33% by weight of glycerides (mono-, di- and triglycerides). The raffinate comprised, minus extraction medium, less than 0.1% of free fatty acids. 2 g glycerides (about 2% of the weighed sample) were in the extract. 1.9% by weight of N,N-dimethylamino-ethanol were dissolved in the raffinate which were washed out with water.

EXAMPLE 8

100 g of palm oil having a content of 4.2% by weight of free fatty acids were extracted at 50° C. with 100 g of a solution of 40% by weight of N,N-dimethylamino-ethanol in water. The extract comprised, minus extraction medium, 75% by weight of fatty acids and 25% by weight of glycerides. In addition to 3.1 g of fatty acids, the extract also comprises 1 g of glycerides (corresponding to a loss of fat of 1%). The raffinate contained 0.1% by weight of fatty acids.

EXAMPLE 9

200 g of a steam distillate comprising 92% of free fatty acids and 0.19% of secondary components (tocopherols+tocotrienols+phytosterines) are dissolved in 400 g heptane fraction at 40° C. The solution is extracted with 600 g of a solution of 40% N,N-dimethylamino-ethanol in water at 40° C. Two clear coexisting phases forming within a few minutes result. The extract (what has been dissolved in the extraction medium) comprises, minus extraction medium, 96% of fatty acids. The raffinate comprises, minus extraction medium, 13.4 g of glycerides, 0.7 g of free fatty acids, and 0.3 g of secondary components (2% tocopherols+tocotrienols+phytosterines).

EXAMPLE 10

In a plant according to the accompanying FIGURE, palm oil was fed into the first extraction tower 12 at a rate of 30.0 kg/h. Since the palm oil comprised 4.3% by weight of free fatty acids, the feed via the line 10 consisted of 28.71 kg/h of neutral oil and 1.29 kg/h of free fatty acids. In the extraction tower 12, the palm oil was brought into contact at 80° C. with 30.0 kg/h of extraction medium in countercurrent. The extraction medium was composed of dimethylaminoethanol (DMAE) and water in a ratio of 1:1. The raffinate stream leaving the extraction tower 12 comprised 24.424 kg/h of neutral oil, 0.090 kg/h of free fatty acids, 0.855 kg/h of DMAE and 0.855 kg/h of water. The extract stream was composed of 14.145 kg/h of DMAE, 14.145 kg/h of water, 0.285 kg/h of neutral oil and 1.20 kg/h of free fatty acids.

The raffinate stream was fed to the wash tower 16, in which the DMAE was extracted from it at 80° C. with 15.0 kg/h of water in countercurrent. The raffinate stream thus purified left the wash tower 16 in the following composition: 28.424 kg/h of neutral oil, 0.012 kg/h of DMAE and less than 0.025 kg/h of free fatty acids. This is equivalent to a neutral oil containing 0.00042 % by weight of DMAE and less than 0.00088% by weight of free fatty acids. The wash water left the wash column 16 with the following composition: 15.855 kg/h of water, 0.855 kg/h of DMAE and 0.064 kg/h of free fatty acids. The wash water was regenerated in the distillation tower 20 at 100° C. As overhead product, 15.0 kg/h of water was recirculated via the line 24 to the wash tower 16. The bottom product containing 0.855 kg/h of water and 0.855 kg/h of DMAE is combined with the extract stream from the extraction tower 12 flowing through the line 26.

The extract stream from the extraction tower 12 combined with the bottom product from the distillation tower 20 was fed to the distillation tower 28. The overhead product of the distillation tower 28 of 15.0 kg/h of water and 15.0 kg/h of DMAE was recirculated as extraction medium via the line 32 into the extraction tower 12. As bottom product, 0.285 kg/h of neutral oil and 1.264 kg/h of free fatty acids left the distillation tower 28. The extract therefore consisted of 18.4% by weight of neutral oil and 81.6% by weight of free fatty acids.

The extraction medium cycle is thus closed, and there are no waste elimination problems.

What is claimed is:

1. A process for removing free fatty acids from fats or oils of biological origin by extracting the free fatty acids with a mixture of basic organic nitrogen compounds and water as extraction medium at a temperature below the boiling point of the organic nitrogen compounds, where the content of the basic organic nitrogen compounds in the extraction medium is at least about 20% by weight and at most about 60% by weight, and the boiling point of the basic organic nitrogen compound(s) used is equal to or above the boiling point of water and below the boiling point of the fatty acids to be extracted.

2. The process according to claim 1, wherein the basic nitrogen compound(s) in the refined fat or oil obtained by the extraction is/are extracted by means of water or aqueous solutions of volatile acids.

3. The process according to claim 1, wherein when fats and oils having a free fatty acid content of about 50% by weight or more are being deacidified, alkanes and/or an ester, are added to the starting materials to be deacidified in a concentration which is sufficient for the system of extraction medium, alkane and starting material to divide into two phases.

4. The process for removing free fatty acids from steam distillates of fats or oils of biological original comprising:

extracting the free fatty acids with a mixture of basic organic nitrogen compounds and water as extraction medium at a temperature below the boiling point of the organic nitrogen compounds, wherein the content of the basic organic nitrogen compounds in the extraction medium is at least about 40% by weight and at most about 60% by weight, and the boiling point of the basic organic nitrogen compound(s) used is equal to or above the boiling point of water and below the boiling point of the fatty acids to be extracted; and adding from 1 to 4 parts, of alkane and/or of an ester, to 1 part of the liquid homogeneous mixture obtained in the preceding extraction step.

5. The process according to claim 3, wherein the basic nitrogen compound(s) in the alkane phase and/or ester phase is/are extracted by means of water or aqueous solutions of volatile acids.

6. The process according to claim 2, wherein the organic nitrogen compound(s) dissolved in the water or the aqueous solution of volatile acids after the extraction step is/are separated off by distillation.

7. The process according to claim 3, wherein the alkane used is selected from the group consisting of propane, butane, pentane, hexane, heptane, heptane fraction, octane and a mixture thereof.

8. The process according to claim 3, wherein the ester used is selected from the group consisting of ethyl acetate, propyl acetate, butyl acetate and a mixture thereof.

9. The process according to claim 1, wherein the extracted fatty acids are separated off from the extraction medium by distillation at atmospheric pressure or reduced pressure of the extraction medium comprising fatty acids.

10. The process according to claim 1, wherein the basic organic nitrogen compound used is a tertiary amine.

11. The process according to claim 1, wherein the basic organic nitrogen compound used is selected from the group consisting of 2-dimethylaminoethanol, 2-methylaminodiethanol, 4-methylmorpholine, 2-diisopropylaminoethanol, 2-dibutylaminoethanol, 2-dimethylaminopropanol, 1-dimethylamino-2-propanol, 2-dimethylaminoethanol, 2-methylamino-1-butanol, 2-(methylethylamino)ethanol, dimethylformamide, morpholine, pyridine, 2-dimethylamino-2-methyl-1-propanol, 4-methylpyridine, 1-methylpyrrole, 2-dibutylaminoethanol, 2-dimethylaminoethylamine, monoethanolamine, 3-dimethylamino-1-propanol, dimethylamino-2-propanone, 1-dimethylamino-1-propylenamine, and a mixture of these compounds.

12. The process according to claim 1, wherein the content of the basic organic nitrogen compounds in the extraction medium is between about 30% by weight and about 40% by weight.

13. The process according to claim 3, wherein the ester is an acetate.

14. The process according to claim 4, wherein the ester is an acetate.

15. The process according to claim 4, wherein the content of the basic organic nitrogen compounds in the extraction medium is at least about 50% by weight.

16. The process according to claim 4, wherein from 2 to 4 parts of alkane and/or an ester are added to 1 part of the liquid homogeneous mixture obtained in the extraction step.

17. The process according to claim 5, wherein the organic nitrogen compound(s) dissolved in the water or the aqueous solution of volatile acids after the extraction step is/are separated off by distillation.

18. The process according to claim 4, wherein the alkane used is selected from the group consisting of propane, butane, pentane, hexane, heptane, heptane fraction, octane or a mixture thereof.

19. The process according to claim 4, wherein the ester used is selected from the group consisting of ethyl acetate, propyl acetate, butyl acetate and a mixture thereof.

20. The process according to claim 4, wherein the extracted fatty acids are separated off from the extraction medium by distillation at atmospheric pressure or reduced pressure of the extraction medium comprising the fatty acids.

21. The process according to claim 4, wherein the basic organic nitrogen compound used is a tertiary amine.

22. The process according to claim 4, wherein the basic organic nitrogen compound used is selected from the group consisting of 2-dimethylaminoethanol, 2-methylaminodiethanol, 4-methylmorpholine, 2-diisopropylaminoethanol, 2-dibutyl-aminoethanol, 2-dimethylaminopropanol, 1-dimethylamino-2-propanol, 2-dimethylaminoethanol, 2-methylamino-1-butanol, 2-(methylethylamino)ethanol, dimethylformamide, morpholine, pyridine, 2-dimethylamino-2-methyl-1-propanol, 4-methylpyridine, 1-methylpyrrole, 2-dibutylaminoethanol, 2-dimethylaminoethylamine, monoethanolamine, 3-dimethylamino-1-propanol, dimethylamino-2-propanone, 1-dimethylamino-1-propylenamine, and a mixture of these compounds.

* * * * *

UNITED STATES PATENT AND TRADEMARK OFFICE

CERTIFICATE OF CORRECTION

PATENT NO. : 6,579,996 B2
DATED : June 17, 2003
INVENTOR(S) : Siegfried Peter et al.

It is certified that error appears in the above-identified patent and that said Letters Patent is hereby corrected as shown below:

Title page,
Item [57], ABSTRACT,
Line 7, "20-30%" should read -- 20-60% --.
Line 11, "above boiling" should read -- above the boiling --.

Column 6,
Line 36, "easil" should read -- easily --.

Signed and Sealed this

Twenty-third Day of August, 2005

JON W. DUDAS
*Director of the United States Patent and Trademark Office*